US006415608B1

(12) United States Patent
Newburry

(10) Patent No.: US 6,415,608 B1
(45) Date of Patent: Jul. 9, 2002

(54) PILOTED RICH-CATALYTIC LEAN-BURN HYBRID COMBUSTOR

(75) Inventor: Donald Maurice Newburry, Orlando, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 16 days.

(21) Appl. No.: 09/670,035

(22) Filed: Sep. 26, 2000

(51) Int. Cl.[7] ..... F23R 3/40
(52) U.S. Cl. ..... 60/723; 417/170
(58) Field of Search ..... 60/39.822, 723; 422/173; 431/170, 328

(56) References Cited

U.S. PATENT DOCUMENTS 4,870,824 A * 10/1989 Young et al. ..... 620/723
5,235,804 A * 8/1993 Colket et al. ..... 60/39.02
5,250,489 A * 10/1993 Betta et al. ..... 502/262
5,461,864 A * 10/1995 Betta et al. ..... 60/723
5,512,250 A * 4/1996 Betta et al. ..... 422/173

* cited by examiner

*Primary Examiner*—Louis J. Casaregola

(57) ABSTRACT

A catalytic combustor assembly which includes, an air source, a fuel delivery means, a catalytic reactor assembly, a mixing chamber, and a means for igniting a fuel/air mixture. The catalytic reactor assembly is in fluid communication with the air source and fuel delivery means and has a fuel/air plenum which is coated with a catalytic material. The fuel/air plenum has cooling air conduits passing therethrough which have an upstream end. The upstream end of the cooling conduits is in fluid communication with the air source but not the fuel delivery means.

23 Claims, 3 Drawing Sheets

PILOTED RICH-CATALYTIC LEAN-BURN HYBRID COMBUSTOR

GOVERNMENT CONTRACT

The government of the United States of America has certain rights in this invention pursuant to contract no. DE-FC21-95MC32267 awarded by the U.S. Department of Energy.

BACKGROUND OF THE INVENTION

Field of the Invention

This invention relates to a catalytic combustor for a combustion turbine and, more specifically, to a piloted rich-catalytic lean-burn hybrid combustor having a plurality of cooling air conduits passing through a fuel/air mixture plenum.

BACKGROUND INFORMATION

Combustion turbines, generally, have three main assemblies: a compressor assembly, a combustor assembly, and a turbine assembly. In operation, the compressor compresses ambient air. The compressed air flows into the combustor assembly where it is mixed with a fuel. The fuel and compressed air mixture is ignited creating a heated working gas. The heated working gas is expanded through the turbine assembly. The turbine assembly includes a plurality of stationary vanes and rotating blades. The rotating blades are coupled to a central shaft. The expansion of the working gas through the turbine section forces the blades, and thereafter the shaft, to rotate. The shaft maybe connected to a generator.

Typically, the combustor assembly creates a working gas at a temperature between 2,500 to 2,900 degrees Fahrenheit (1371 to 1593 degrees centigrade). At high temperatures, particularly above about 1,500 degrees centigrade, the oxygen and nitrogen within the working gas combine to form the pollutants NO and $NO_2$, collectively known as NOx, a known pollutant. The formation rate of NOx increases exponentially with flame temperature. Thus, for a given engine working gas temperature, the minimum NOx will be created by the combustor assembly when the flame is at a uniform temperature, that is, there are no hot spots in the combustor assembly. This is accomplished by premixing all of the fuel with all of the of air available for combustion (referred to as low NOx lean-premix combustion) so that the flame temperature within the combustor assembly is uniform and the NOx production is reduced.

Lean pre-mixed flames are generally less stabile than non-well-mixed flames, as the high temperature regions of non-well-mixed flames add to a flame's stability. One method of stabilizing lean premixed flames is to react some of the fuel/air mixture in a catalyst prior to the combustion zone. To utilize the catalyst, a fuel/air mixture is passed over a catalyst material, or catalyst bed, causing a pre-reaction of a portion of the mixture and creates radical which aid in stabilizing combustion at a downstream location within the combustor assembly.

Prior art catalytic combustors completely mix the fuel and the air prior to the catalyst. This provides a fuel lean mixture to the catalyst. However, with a fuel lean mixture, typical catalyst materials are not active at compressor discharge temperatures. As such, a preburner is required to heat the air prior to the catalyst adding cost and complexity to the design as well as generating NOx emissions, See e.g., U.S. Pat. No. 5,826,429. It is, therefore, desirable to have a combustor assembly that burns a fuel lean mixture, so that NOx is reduced, but passes a fuel rich mixture through the catalyst bed so that a preburner is not required.

One disadvantage of using a catalyst is that the catalyst is subject to degradation when exposed to high temperatures. High temperatures may be created by the reaction between the catalyst and the fuel, pre-ignition within the catalyst bed, and/or flashback ignition from the downstream combustion zone extending into the catalyst bed. To reduce the temperature within the catalyst bed, prior art catalyst beds included cooling conduits which pass through the catalyst bed. The cooling conduits were free of the catalyst material and allowed a portion of the fuel/air mixture to pass, unreacted, through the cooling conduits. Another portion of the fuel/air mixture passed over, and reacted with the catalyst bed. Then, the two portions of the fuel/air mixture were combined. The unreacted fuel/air mixture absorbed heat created by the reaction of the fuel with the catalyst and/or any ignition or flashback within the catalyst bed. See e.g., U.S. Pat. No. 4,870,824 and U.S. Pat. No. 4,512,250.

The disadvantage of such cooling systems is that the cooling conduits utilize a gas comprising a fuel/air mixture. This fuel/air mixture is subject to premature ignition within the cooling conduits. Such premature ignition would destroy the heat absorbing capability of the fuel/air mixture thereby allowing the catalyst bed to overheat.

There is, therefore, a need for a catalytic reactor assembly for a combustion turbine, which includes a cooling means that does not rely on a fuel/air mixture to be a cooling fluid.

There is a further need for a catalytic reactor assembly for a combustion turbine, which eliminates the possibility of igniting the gas within a cooling passage.

There is a further need for a catalytic reactor assembly which improves the performance of the catalyst to a point where a preburner is no longer required.

There is a further need for a catalytic reactor assembly which maybe retrofitted with existing combustor designs.

SUMMARY OF THE INVENTION

These needs, and others, are satisfied by the disclosed invention which provides a catalytic reactor assembly having a fuel/air plenum with cooling conduits passing therethough. The cooling conduits are in fluid communication with an air source. The outer surface of the cooling conduits and the inner surface of the fuel/air plenum are coated with a catalytic material. The fuel/air plenum and the cooling air conduits each have a downstream end which is in fluid communication with a mixing chamber. Thus, a fuel rich fuel/air mixture may pass through the fuel/air plenum. Air passes through the cooling conduits. When the fuel/air mixture and the cooling air are mixed, a fuel lean pre-ignition gas is created. The fuel lean pre-ignition gas is ignited creating a working gas with a reduced amount of NOx.

The fuel/air plenum is created by an inner shroud and an end plate which is located opposite the downstream end of the fuel/air mixture plenum. A first plenum surrounds the fuel/air plenum. The first plenum is in fluid communication with a fuel source and an air source. The air source may be the same source which provides air to the cooling conduits. At the downstream end of the mixing chamber is a flame chamber and igniter assembly.

The catalytic reactor assembly may be included in the combustor assembly of a combustion turbine which includes a compressor assembly, a combustor assembly and a turbine assembly. Typically, the combustion turbine includes an outer shell which encloses a plurality of combustor assemblies. The outer shell creates a compressed air plenum which is fluid communication with the compressor assembly. At the downstream end of the combustor assemblies are transition sections, which are also enclosed within the compressed air plenum, which are coupled to the turbine assembly.

It is advantageous to have a fuel rich mixture in the catalyst section for several reasons. For example, the catalyst is more active because more fuel is in contact with the catalytic material. This allows the catalyst to be active at temperatures below the temperature of the air at the exit of the compressor. Therefore a pre-burner is not required upstream of the catalyst to preheat the fuel/air mixture. Additionally, having an oxygen lean environment in the catalyst zone controls the amount of fuel that is reacted. When less fuel is reacted, less heat is created therefore limiting the temperature in the catalyst bed.

In operation the compressor assembly compresses ambient air which is delivered to the compressed air plenum. Compressed air within the compressed air plenum is split into at least two portions: the first portion enters the first plenum and the second portion travels through the cooling conduits. A third portion may be directed to an pilot assembly. Within the first plenum, a fuel is introduced from a fuel source and mixed with the first compressed air flow to create a fuel rich fuel/air mixture. The fuel rich fuel/air mixture is delivered to the fuel/air plenum which surrounds the cooling air conduits and is in contact with the catalyst material. The fuel rich fuel/air mixture is reacted with the catalyst material and delivered to the mixing chamber. The second portion of compressed air enters the cooling chambers and absorbs heat from the catalytic reaction. The second portion of the compressed air then passes into the mixing chamber where it is mixed with the heated fuel/air mixture to create a pre-ignition gas. The combined pre-ignition gas contains an excess of air and is, therefore, fuel lean. The fuel lean pre-ignition gas is delivered to a flame zone where it auto-ignites or is ignited by the pilot assembly creating a working gas. The working gas travels through the transition sections and is delivered to the turbine assembly.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE PREFERRED EMBODIMENT

Figure 1:
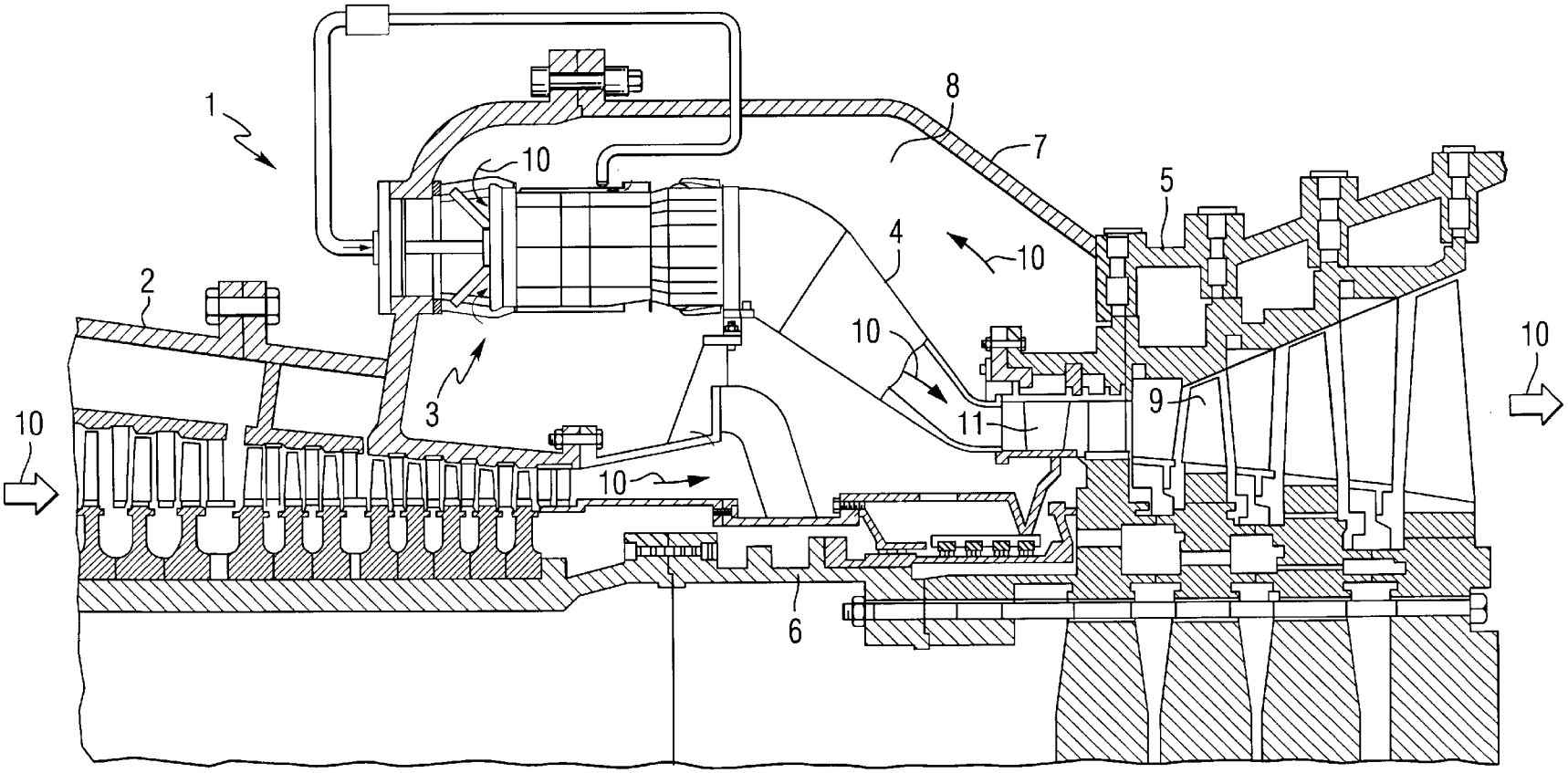
FIG. 1 is a cross sectional view of a combustion turbine.

As is well known in the art and shown in FIG. 1, a combustion turbine includes a compressor assembly 2, a catalytic combustor assembly 3, a transition section 4, and a turbine assembly 5. A flow path 10 exists through the compressor 2, catalytic combustor assembly 3, transition section 4, and turbine assembly 5. The turbine assembly 5 may be mechanically coupled to the compressor assembly 2 by a central shaft 6. Typically, an outer casing 7 encloses a plurality of catalytic combustor assemblies 3 and transition sections 4. Outer casing 7 creates a compressed air plenum 8. The catalytic combustor assemblies 3 and transition sections 4 are disposed within the compressed air plenum 8. The catalytic combustor assemblies 3 are, preferably, disposed circumferentiality about the central shaft 6.

In operation, the compressor assembly 2 inducts ambient air and compresses it. The compressed air travels through the flow path 10 to the compressed air plenum 8 defined by casing 7. Compressed air within the compressed air plenum 8 enters a catalytic combustor assembly 3 where, as will be detailed below, the compressed air is mixed with a fuel and ignited to create a working gas. The working gas passes from the catalytic combustor assembly 3 through transition section 4 and into the turbine assembly 5. In the turbine assembly 5 the working gas is expanded through a series of rotatable blades 9 which are attached to shaft 6 and the stationary vanes 11. As the working gas passes through the turbine assembly 5, the blades 9 and shaft 6 rotate creating a mechanical force. The turbine assembly 5 can be coupled to a generator to produce electricity.

Figure 2:
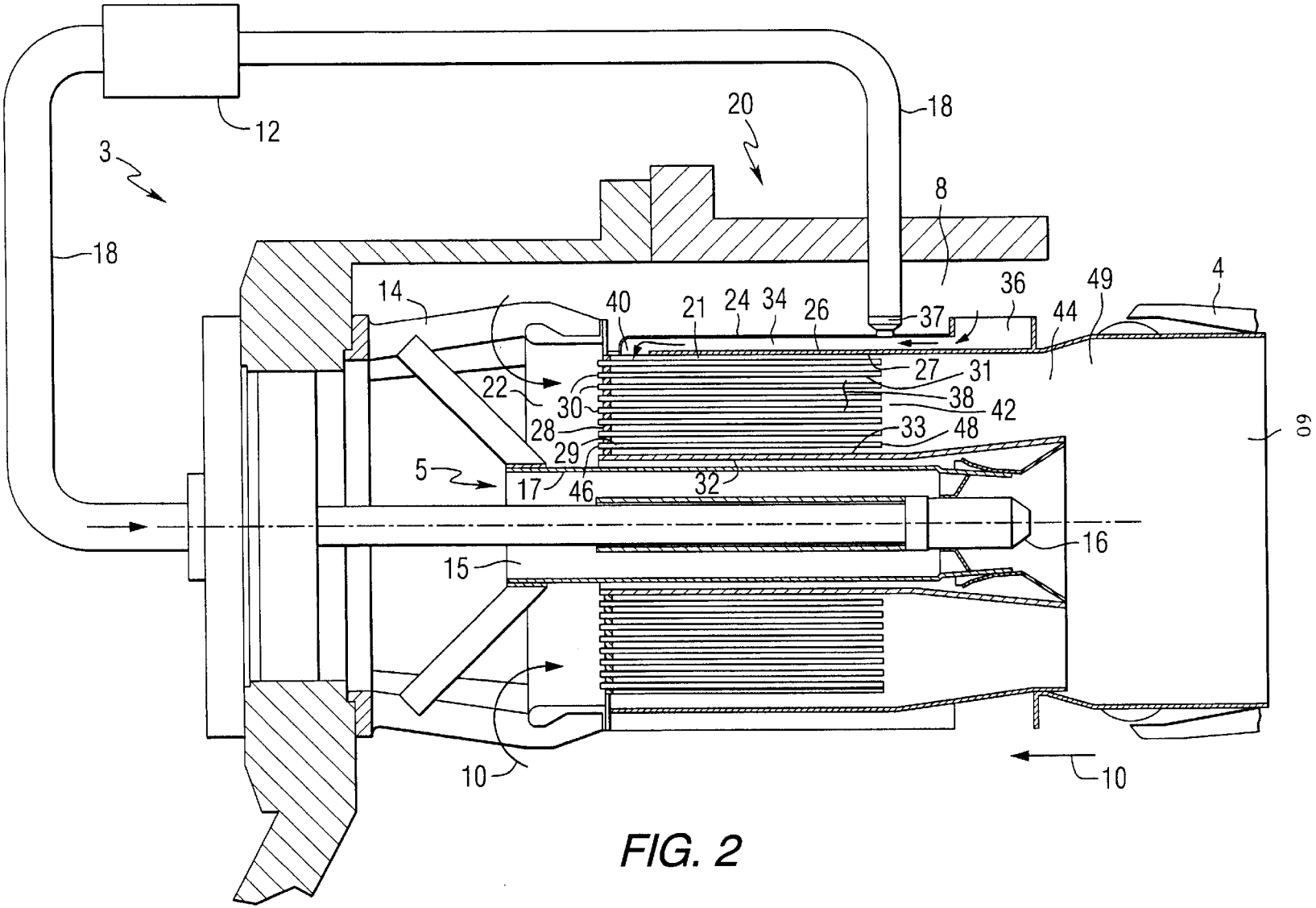
FIG. 2 is a detailed partial cross sectional view of a combustor assembly shown on FIG. 1.

As shown in FIG. 2, the catalytic combustor assembly 3 includes a fuel source 12, a support frame 14, an pilot assembly 16, fuel conduits 18, and a catalytic reactor assembly 20. The catalytic reactor assembly 20 includes a catalytic core 21, an inlet nozzle 22, and an outer shell 24. The catalytic core 21 includes an inner shell 26, an end plate 28, a plurality of cooling conduits 30, and an inner wall 32. The catalytic core 21 is an elongated toroid which is disposed axially about the igniter assembly 16. Inner wall 32 is disposed adjacent to igniter assembly 16. Both the inner shell 26 and the inner wall 32 have interior surfaces 27, 33 respectively, located within the fuel/air plenum 38 (described below).

Outer shell 24 is in a spaced relation to inner shell 26 thereby creating a first plenum 34. The first plenum 34 has a compressed air inlet 36. The compressed air inlet 36 is in fluid communication with an air source, preferably the compressed air plenum 8. A fuel inlet 37 penetrates outer shell 24. Fuel inlet 37 is located downstream of air inlet 36. The fuel inlet 37 is in fluid communication with a fuel conduit 18. The fuel conduit is in fluid communication with the fuel source 12.

A fuel/air plenum 38 is defined by endplate 28, inner shell 26, and inner wall 32. There is at least one fuel/air mixture inlet 40 on inner shell 26, which allows fluid communication between first plenum 34 and fuel/air plenum 38. The fuel/air plenum 38 has a downstream end 42, which is in fluid communication with a mixing chamber 44.

The plurality of cooling conduits 30 each have a first end 46 and a second end 48. Each cooling conduit first end 46 extends through plate 28 and is in fluid communication with inlet nozzle 22. The cooling conduit first ends 46, which are the upstream ends, are isolated from the fuel inlet 37. Thus, fuel cannot enter the first end 46 of the cooling conduits 30. Each cooling conduit second end 48 is in fluid communication with mixing chamber 44. The conduits 30 have an interior surface 29 and an exterior surface 31. A catalytic material, such as platinum or palladium, may be bonded to the conduit outer surface 31. Additionally, the catalytic material may be bonded to the interior surface 27 of inner shell 26 and the interior surface 33 of inner wall 32. Thus, the surfaces within the fuel/air plenum 38 are, generally, coated with a catalytic material. In the preferred embodiment, the cooling conduits are tubular members. The cooling conduits 30 may, however, be of any shape and may be constructed of members such as plates.

The mixing chamber 44 has a downstream end 49, which is in fluid communication with a flame zone 60. Flame zone 60 is also in fluid communication with pilot assembly 16.

The pilot assembly 16 includes an outer wall 17, which defines an annular passage 15. The annular passage 15 is in fluid communication with compressed air plenum 8. The pilot assembly 16 is in further communication with a fuel conduit 18. The pilot assembly 16 mixes compressed air from annular passage 15 and fuel from conduit 18 and ignites the mixture with a spark igniter. The compressed air in annular passage 15 is swirled by vanes in annular passage 15. The angular momentum of the swirl causes a vortex flow with a low-pressure region along the centerline of the pilot assembly 16. Hot combustion products from flame zone 60 are re-circulated upstream along the low-pressure region and continuously ignite the incoming fuel air mixture to create a stabile pilot flame. Alternately, the spark igniter may be used when pilot flame is unstable.

In operation air from an air source, such as the compressed air plenum 8, is divided into at least two portions; a first portion, which is about 10 to 20 percent of the compressed air in the flow path 10, flows through air inlet 36 into the first plenum 34. A second portion of air, which is about 75 to 85 percent of the compressed air within the flow path 10, flows through inlet 22 into cooling conduits 30. A third portion of air, which is about 5 percent of the compressed air in the flow path 10, may flow through the pilot assembly 16.

The first portion of air enters the first plenum 34. Within first plenum 34 the compressed air is mixed with a fuel that enters first plenum 34 through fuel inlet 37 thereby creating a fuel/air mixture. The fuel/air mixture is, preferably, fuel rich. The fuel rich fuel/air mixture passes through fuel/air inlet 40 into the fuel/air plenum 38. As the fuel rich fuel/air mixture, which is created in first plenum 34, enters the fuel/air plenum 38. The fuel/air mixture reacts with the catalytic material disposed on the conduit outer surfaces 31, inner shell interior surface 27, and inner wall interior surface 33. The reacted fuel/air mixture exits the fuel/air plenum 38 into mixing chamber 44.

The second portion of air travels through inlet 22 and enters the cooling conduit first ends 46, traveling through cooling conduits 30 to cooling conduit second end 48. Air which has traveled through cooling conduits 30 also enters mixing chamber 44. As the air travels through conduits 30, it absorbs heat created by the reaction of the fuel/air mixture with the catalytic material. Within mixing chamber 44, the reacted fuel/air mixture and compressed air is further mixed to create a fuel lean pre-ignition gas. The fuel lean pre-ignition exits the downstream end of the mixing chamber 49 and enters the flame zone 60. Within flame zone 60 the fuel lean pre-ignition gas is ignited by pilot assembly 16 thereby creating a working gas.

The use of the catalytic material allows a controlled reaction of the rich fuel/air mixture at a relatively low temperature such that almost no NOx is created in fuel/air plenum 38. The reaction of a portion of the fuel and air preheats the fuel/air mixture which aids in stabilizing the downstream flame in flame zone 60. When the fuel rich mixture is combined with the air, from the second portion of compressed air, a fuel lean pre-ignition gas is created. Because the pre-ignition gas is fuel-lean, the amount of NOx created by the combustor assembly is reduced. Because compressed air only travels through the cooling conduits 30, there is no chance that a fuel air mixture will ignite within the cooling conduits 30. Thus, the cooling conduits 30 will always be effective to remove heat from the fuel/air plenum 38 thereby extending the working life of the catalytic material.

Figure 3:
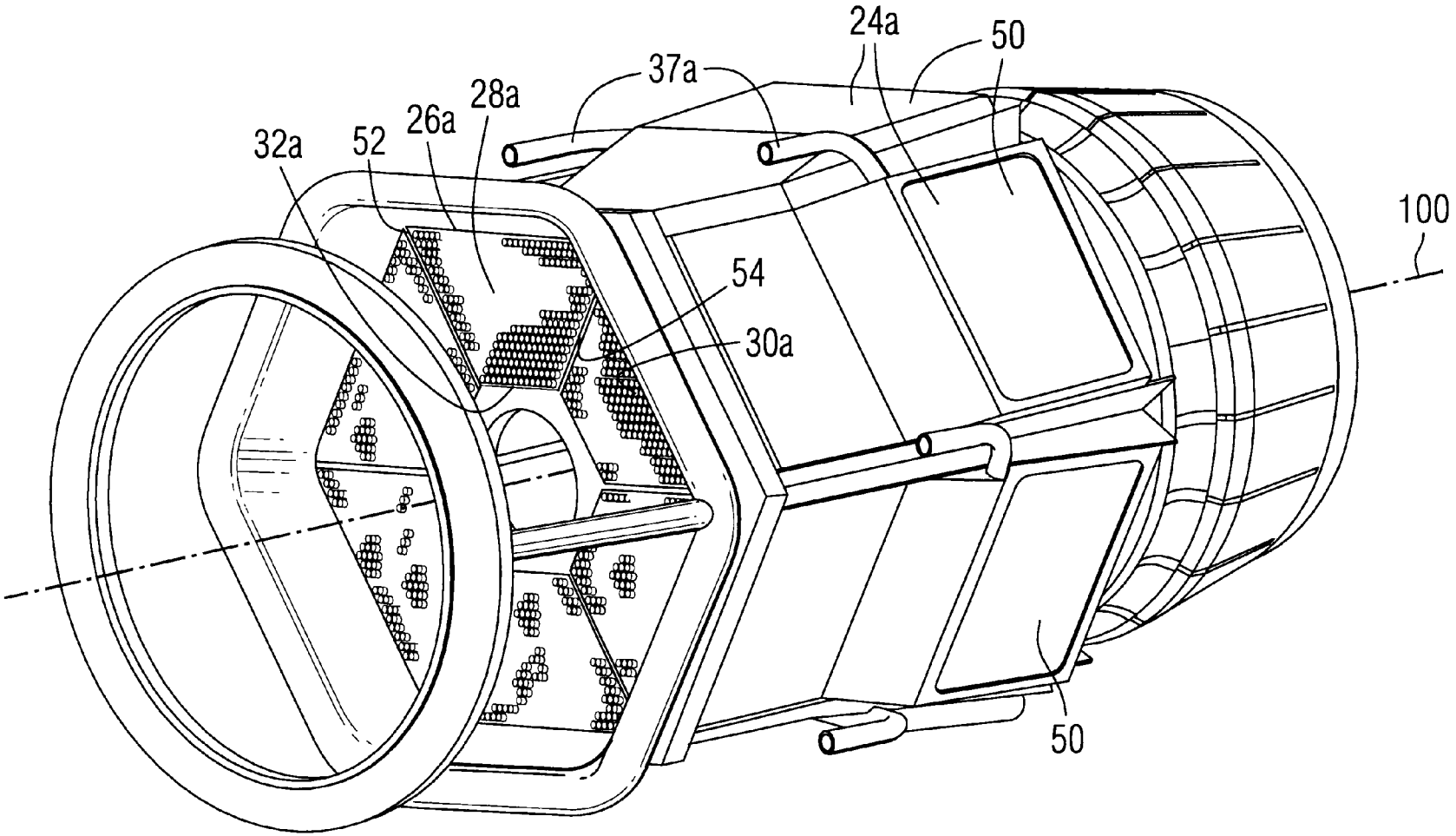
FIG. 3 is an isometric view showing modular catalytic cores disposed about a central axis.

As shown in FIG. 3, for ease of construction the catalytic reactor assembly may be separated into modules 50 that are disposed about a central axis 100. Each module 50 includes inner shell 26*a*, an inner wall 32*a* and sidewalls 52, 54. A plurality of cooling conduits 30*a* are enclosed by inner shell 26*a*, inner wall 32*a* and sidewalls 52, 54. Each module also has an end plate 28*a*, an outer shell 24*a* and a fuel inlet 37*a*. As shown, six modules 50 form a generally hexagonal shape about the central axis 100. Of course, any number of modules 50 of various shapes could be used.

While specific embodiments of the invention have been described in detail, it will be appreciated by those skilled in the art that various modifications and alternatives to those details could be developed in light of the overall teachings of the disclosure. For example, although the catalytic core has been shown as being disposed circumferentially about the pilot assembly, the catalytic core could be disposed on just one side of the pilot assembly. Accordingly, the particular arrangements disclosed are meant to be illustrative only and not limiting as to the scope of invention which is to be given the full breadth of the claims appended and any and all equivalents thereof.

What is claimed is:

1. A catalytic combustor assembly comprising:

an air source;

a fuel delivery means;

a catalytic reactor assembly in fluid communication with said air source and fuel delivery means and having a fuel/air plenum which is coated with a catalytic material;

said fuel/air plenum having cooling air conduits passing therethrough having an upstream end;

said cooling conduits in fluid communication with said air source and isolated from said fuel delivery means at said upstream end;

a mixing chamber in fluid communication with said fuel/air plenum and said cooling air conduits; and a means for igniting a fuel/air mixture.

2. The catalytic combustor of claim 1, wherein said catalytic reactor assembly includes an outer shell and an elongated catalytic core;

said catalytic core spaced from said outer shell creating a first plenum;

said outer shell having at least one fuel inlet and at least one air inlet;

said catalytic core forming said fuel/air plenum having the plurality of cooling air conduits passing axially therethrough;

said fuel/air plenum in fluid communication with said first plenum; and wherein fuel and air may be introduced through said fuel inlet and said air inlet into said first plenum creating a fuel/air mixture which is then passed through said fuel/air plenum.

3. The catalytic combustor of claim 2, wherein said air source is further in fluid communication with both said air inlet and said cooling conduits.

4. The catalytic combustor of claim 3, wherein:

said fuel/air plenum and cooling conduits each have a downstream end; and said downstream end of said fuel/air plenum and said downstream end of said cooling conduits are in fluid communication with said mixing chamber.

5. The catalytic combustor of claim 4, wherein:

said means for igniting a fuel/air mixture is an pilot assembly;

said mixing chamber has a downstream end;

said downstream end is disposed adjacent to said pilot assembly; and said downstream end is in fluid communication with said pilot assembly.

6. The catalytic combustor of claim 5, wherein:

said catalytic core has an inner shell, an upstream end and an inner wall;

said catalytic core includes a plate at said upstream end of said inner wall;

said inner shell, said inner wall and said end plate define said fuel/air plenum;

said cooling conduits include a plurality of tubular members having open upstream ends and open downstream ends; and said plurality of tubular member open upstream ends passing through said end plate.

7. The catalytic combustor of claim 6, wherein said tubular member open upstream ends are in fluid communication with said air source.

8. The catalytic combustor of claim 7, wherein:

said catalytic reactor assembly includes a flame zone;

said flame zone is disposed downstream of, and in fluid communication with, said mixing chamber and pilot assembly.

9. A combustion turbine comprising:

a compressor assembly;

a catalytic combustor assembly;

a turbine assembly;

an outer casing surrounding said catalytic combustor assembly and defining a compressed air plenum;

a flow path extending through said compressor assembly, said compressed air plenum, said catalytic combustor assembly, and turbine assembly;

wherein said catalytic combustor assembly includes:

a fuel delivery means;

a catalytic reactor assembly in fluid communication with said compressed air plenum and fuel delivery means and having a fuel/air plenum which is coated with a catalytic material;

said fuel/air plenum having cooling air conduits passing therethrough having an upstream end;

said cooling conduits in fluid communication with said air source and isolated from said fuel delivery means at said upstream end;

a mixing chamber in fluid communication with said fuel/air plenum and said cooling air conduits; and a means for igniting a fuel/air mixture.

10. The catalytic combustor of claim 9, wherein:

said catalytic reactor assembly includes an outer shell and an elongated catalytic core;

said catalytic core spaced from said outer shell creating a first plenum;

said outer shell having at least one fuel inlet and at lease one air inlet;

said catalytic core forming said fuel/air plenum having said plurality of cooling air conduits passing axially therethrough;

said fuel/air plenum in fluid communication with said first plenum; and wherein fuel and air may be introduced through said fuel inlet and said air inlet into said first plenum creating a fuel/air mixture which is then passed through said fuel/air plenum.

11. The combustion turbine of claim 10, wherein:

said means for igniting a fuel/air mixture is an pilot assembly;

said fuel/air plenum and cooling conduits each have a downstream end; and said downstream end of said fuel/air plenum and said downstream end of said cooling conduits are in fluid communication with said mixing chamber.

12. The combustion turbine of claim 11, wherein said mixing chamber has a downstream end;

said downstream end is disposed adjacent to said pilot assembly; and said downstream end is in fluid communication with said pilot assembly.

13. The combustion turbine of claim 12, wherein:

said catalytic core has an inner shell, an upstream end and an inner wall;

said catalytic core includes a plate at said upstream end of said inner wall;

said inner shell, said inner wall and said end plate define said fuel/air plenum;

said cooling conduits include a plurality of tubular members having open upstream ends and open downstream ends; and said plurality of tubular member open upstream ends passing through said end plate.

14. The combustion turbine of claim 13, wherein said tubular member open upstream ends are in fluid communication with said compressed air plenum.

15. The combustion turbine of claim 14, wherein:

said catalytic reactor assembly includes a flame zone;

said flame zone is disposed downstream of, and in fluid communication with, said mixing chamber and said pilot assembly.

16. A modular catalytic combustor assembly comprising:

an air source;

a fuel delivery means;

a plurality of modular catalytic reactor assemblies each having an outer shell, an inner shell, an inner wall and two side walls;

said inner shell, inner wall and side walls forming a fuel/air plenum said fuel/air plenum in fluid communication with said air source and fuel delivery means and coated with a catalytic material;

said fuel/air plenum having cooling air conduits passing therethrough having an upstream end;

said cooling conduits in fluid communication with said air source and isolated from said fuel delivery means at said upstream end;

a mixing chamber in fluid communication with said fuel/air plenum and said cooling air conduits; and a means for igniting a fuel/air mixture.

17. The modular catalytic combustor of claim 16, wherein:

said outer shell has at least one fuel inlet and at least one air inlet, said outer shell being spaced apart from said inner shell forming a first plenum;

said fuel/air plenum in fluid communication with said first plenum; and wherein fuel and air may be introduced through said fuel inlet and said air inlet into said first plenum creating a fuel/air mixture which is then passed through said fuel/air plenum.

18. The modular catalytic combustor of claim 17, wherein said air source is further in fluid communication with both said air inlet and said cooling conduits.

19. The modular catalytic combustor of claim 18, wherein:

said fuel/air plenum and cooling conduits each have a downstream end; and said downstream end of said fuel/air plenum and said downstream end of said cooling conduits are in fluid communication with said mixing chamber.

20. The modular catalytic combustor of claim 19, wherein:

said means for igniting a fuel/air mixture is an pilot assembly;

said mixing chamber has a downstream end;

said downstream end is disposed adjacent to said pilot burner; and said downstream end is in fluid communication with said pilot assembly.

21. The modular catalytic combustor of claim 20, wherein:

said catalytic core has an inner shell, an upstream end and an inner wall;

said catalytic core includes a plate at said upstream end of said inner wall;

said inner shell, said inner wall and said end plate define said fuel/air plenum;

said cooling conduits include a plurality of tubular members having open upstream ends and open downstream ends; and said plurality of tubular members open upstream ends passing through said end plate.

22. The modular catalytic combustor of claim 21, wherein said tubular members open upstream ends are in fluid communication with said air source.

23. The modular catalytic combustor of claim 22, wherein:

said catalytic reactor assembly includes a flame zone;

said flame zone is disposed downstream of, and in fluid communication with, said mixing chamber and pilot assembly.

* * * * *